US009475664B2

(12) United States Patent
Yonemoto

(10) Patent No.: US 9,475,664 B2
(45) Date of Patent: Oct. 25, 2016

(54) DOCUMENT CONVEYANCE DEVICE AND IMAGE FORMING APPARATUS

(71) Applicant: KYOCERA Document Solutions Inc., Osaka (JP)

(72) Inventor: Satoru Yonemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/003,565

(22) Filed: Jan. 21, 2016

(65) Prior Publication Data

US 2016/0236885 A1 Aug. 18, 2016

(30) Foreign Application Priority Data

Feb. 13, 2015 (JP) ..... 2015-026402

(51) Int. Cl.
*B65H 7/14* (2006.01)
*B65H 5/06* (2006.01)
*B65H 3/06* (2006.01)

(52) U.S. Cl.
CPC *B65H 7/14* (2013.01); *B65H 3/06* (2013.01); *B65H 5/06* (2013.01)

(58) Field of Classification Search
CPC ..... B65H 3/06; B65H 5/06; B65H 7/02; B65H 7/14; B65H 7/18; B65H 7/20; B65H 2511/20; B65H 2511/51; B65H 2553/41; B65H 2553/412; B65H 2553/82
USPC ..... 271/10.02, 10.03, 259, 265.02
See application file for complete search history.

(56) References Cited

U.S. PATENT DOCUMENTS

| | | | | |
|---|---|---|---|---|
| 5,964,460 | A | 10/1999 | Azumi et al. | 271/265.01 |
| 2011/0248439 | A1 | 10/2011 | Oshima | 271/3.16 |
| 2013/0308169 | A1* | 11/2013 | Kuo | B65H 85/00 358/498 |
| 2015/0274461 | A1* | 10/2015 | Ota | B65H 5/068 271/265.02 |

FOREIGN PATENT DOCUMENTS

| | | | |
|---|---|---|---|
| JP | S6351900 | A | 3/1988 |
| JP | H 10-114445 | A | 5/1998 |
| JP | 2000-314991 | A | 11/2000 |
| JP | 2011-79644 | A | 4/2011 |

* cited by examiner

*Primary Examiner* — David H Bollinger
(74) *Attorney, Agent, or Firm* — Stein IP, LLC

(57) ABSTRACT

A document conveyance device according to the present disclosure includes a document conveyance path, a first actuator, a second actuator, and an optical sensor. The first actuator is disposed in the document conveyance path. The second actuator is disposed on a more downstream side than the first actuator in the document conveyance path in the document conveyance direction. An output state of the optical sensor is switched based on pivoting of the first actuator and second actuator. A tip end of the document passes the first actuator, whereby the optical sensor outputs a first output indicating a first state, the tip end of the document passes the second actuator, whereby the optical sensor outputs a second output indicating a second state, and a rear end of the document passes the first actuator, whereby the optical sensor outputs the first output.

8 Claims, 7 Drawing Sheets

DOCUMENT CONVEYANCE DEVICE AND IMAGE FORMING APPARATUS

INCORPORATION BY REFERENCE

The present application is based on Japanese Patent Application No. 2015-026402 filed of Feb. 13, 2015, the contents of which are hereby incorporated by reference.

BACKGROUND

The present disclosure relates to a document conveyance device and an image forming apparatus that includes the document conveyance device, more particularly, to a document conveyance device that includes a sensor for detecting a document passing in a document conveyance path and an image forming apparatus that includes the document conveyance device.

There are some image forming apparatuses, such as a copy machine, a facsimile, a scanner and the like, include a document conveyance device that automatically sends a plurality of documents to a document reading portion. The document conveyance device separates documents from a bundle of documents loaded in a document placement tray one after another beginning with the uppermost document, and sends the documents to the document reading portion. After an image on a surface of the document is read by the document reading portion, the document is delivered to a document delivery tray that is disposed on the most downstream side of a document conveyance path.

For example, to count a reading start timing at the document reading portion, a next sheet feeding timing and the like, the document conveyance device needs to include a sensor that detects a tip end and rear end of the document. Because of this, a document conveyance device is known in which a document conveyance path is provided with only one sensor that detects presence of a document.

Besides, a document conveyance device is known in which a document conveyance path is provided with two sensors one of which detects a tip end of a document and the other of which detects a rear end of the document.

SUMMARY

A document conveyance device according to an aspect of the present disclosure includes a document conveyance path, a first actuator, a second actuator, and an optical sensor. A document passes through the document conveyance path. The first actuator is disposed in the document conveyance path and pivots in a predetermined direction by being butted by the document. The second actuator is disposed on a more downstream side than the first actuator in the document conveyance path in a document conveyance direction and pivots in the predetermined direction by being butted by the document. An output state of the optical sensor is switched based on the pivoting of the first actuator and second actuator. The optical sensor outputs: a first output indicating a first state in a state in which the document does not pass the first actuator and the second actuator; the first output in a state in which a tip end of the document passes the first actuator, whereby only the first actuator of the first actuator and second actuator pivots in the predetermined direction; a second output indicating a second state, different from the first state, in which the tip end of the document passes the second actuator, whereby both the first actuator and the second actuator pivot in the predetermined direction; and the first output in a state in which a rear end of the document passes the first actuator, whereby the first actuator pivots in a direction opposite to the predetermined direction and the second actuator pivots in the predetermined direction.

Still other objects of the present disclosure and specific advantages obtained by the present disclosure will become more apparent from the following description of a preferred embodiment.

DETAILED DESCRIPTION

Hereinafter, an embodiment of the present disclosure is described with reference to the drawings.

Figure 1:
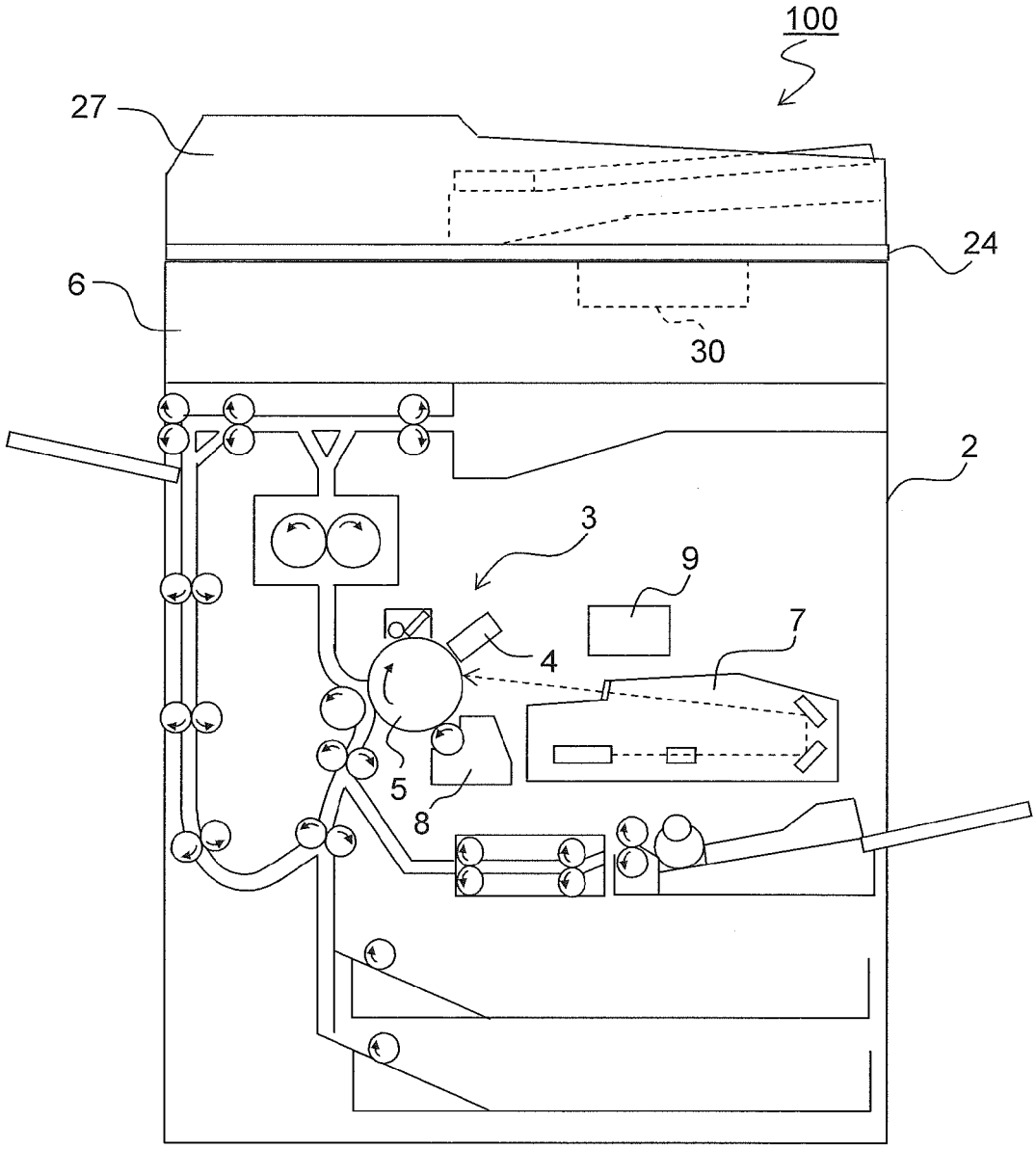
FIG. 1 is a cross-sectional view showing schematically a structure of an image forming apparatus that includes a document conveyance device according to an embodiment of the present disclosure.

With reference to FIG. 1 to FIG. 7, an image forming apparatus 100 including a document conveyance device 27 according to an embodiment of the present disclosure is described. In FIG. 1, in the image forming apparatus 100 (here, a digital multi-functional machine is shown as an example), in a case where a copy operation is performed, an image reading device 6 described later reads image data of a document and converts the image data into an image signal. On the other hand, in an image forming portion 3 in a multi-functional machine main body 2, a photosensitive drum 5, which rotates in a clockwise direction in the figure, is evenly electrified by the electrifying unit 4, an electrostatic latent image is formed, based on the document image data read by the image reading device 6, onto the photosensitive drum 5 by a laser beam from a light exposure unit (laser scanning unit and the like) 7, a developer (hereinafter, called a toner) is made to adhere to the electrostatic latent image by a developing unit 8, whereby a toner image is formed. Toner supply to the developing unit 8 is performed from a toner container 9.

The image reading device 6 is disposed on the multi-functional machine main body 2, an upper surface of the multi-functional machine main body 2 is provided with a platen (document pusher) 24 that is disposed in an openable and closable manner, pushes and holds the document placed on a contact glass (not shown) of the image reading device 6, and the platen 24 is provided thereon with the document conveyance device 27 that automatically conveys the document to a document reading portion (not shown) of the image reading device 6.

Figure 2:
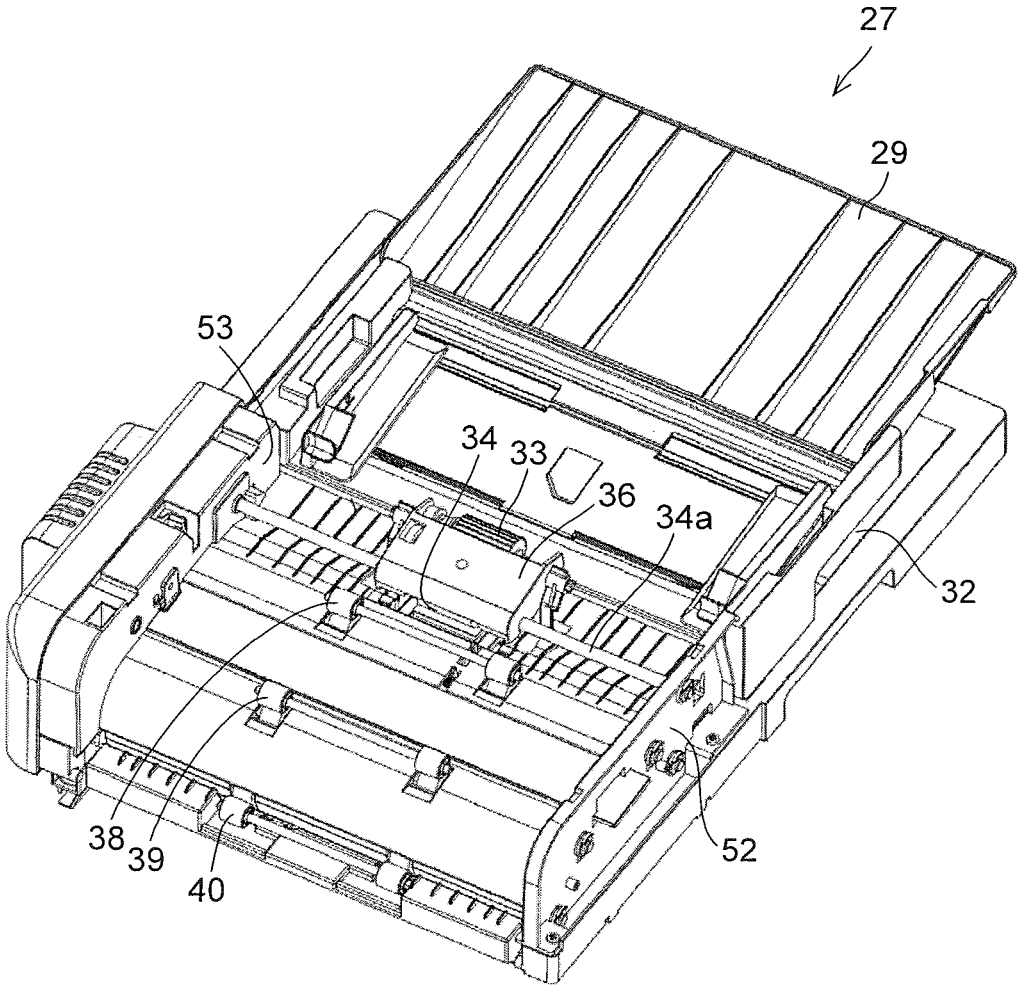
FIG. 2 is a perspective view showing a state in which a cover member of the document conveyance device according to the embodiment of the present disclosure is removed.
Figure 3:
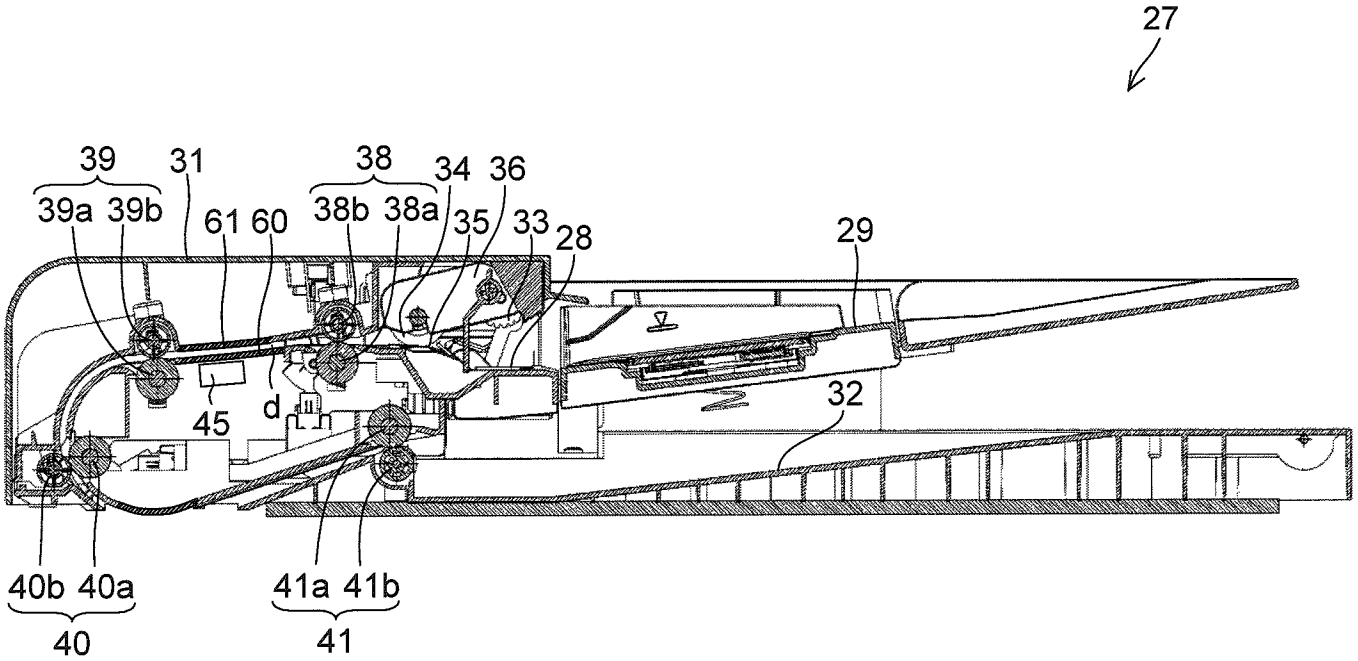
FIG. 3 is a cross-sectional view showing a structure of the document conveyance device according to the embodiment of the present disclosure.

As shown in FIG. 2 and FIG. 3, in a cover member 31 (see FIG. 3) of the document conveyance device 27, a document conveyance path d is formed which extends from a document feeding tray (document loading portion) 29 to a document delivery tray 32, and along the document conveyance path d, a document conveyance member is disposed which is composed of a pickup roller 33, a sheet feeding roller 34, a separating plate 35, conveyance roller pairs 38, 39, 40, and a delivery roller pair 41.

In the meantime, the document conveyance path d bends in substantially a U shape to make a U-turn between the sheet feeding roller 34 and the delivery roller pair 41.

Next, a document conveyance operation of sheet-through type, which uses the document conveyance device 27, is described. In the sheet-through type, a plurality of documents are set onto the document feeding tray 29 with an image surface facing upward, thereafter, when a copy start button on an operation panel 30 (see FIG. 1) of the image forming apparatus 100 is turned on, a lift plate 28 stepped up by a stepping-up/down mechanism (not shown) pushes up the pickup roller 33 via the document, and a weight of a frame body (not shown) including the pickup roller 33 acts on the lift plate 28, whereby an upper surface of the document is pushed against the pickup roller 33 with a predetermined pressure (sheet feeding pressure).

As to the documents loaded in the document feeding tray 29, usually a plurality of upper documents are sent by the pickup roller 33 to a nip portion between the sheet feeding roller 34 and the separating plate 35. And, of the plurality of documents, only the uppermost one is separated by the separating plate 35 and conveyed to the conveyance roller pair 38.

The document is conveyed by the conveyance roller pairs 38, 39, and 40 to the delivery roller pair 41 via an automatic reading glass (not shown) of the contact glass, thereafter, finally delivered onto the document delivery tray 32 by the delivery roller pair 41. At that time, a delivery sensor (not shown) detects passage of a rear end of the document, whereby completion of the image reading of the one document is detected.

In the meantime, as to the document, when passing the automatic reading glass (not shown), the image is read by an image reading portion of the image reading device 6 through the automatic reading glass (not shown).

Next, a structure of the document conveyance device 27 is described in detail.

As shown in FIG. 3, the document conveyance path d has a conveyance surface whose cross-section along the document conveyance direction is substantially a U-shape, is composed of an inner conveyance guide member 60 and an outer conveyance guide member 61 that guide the document.

Figure 4:
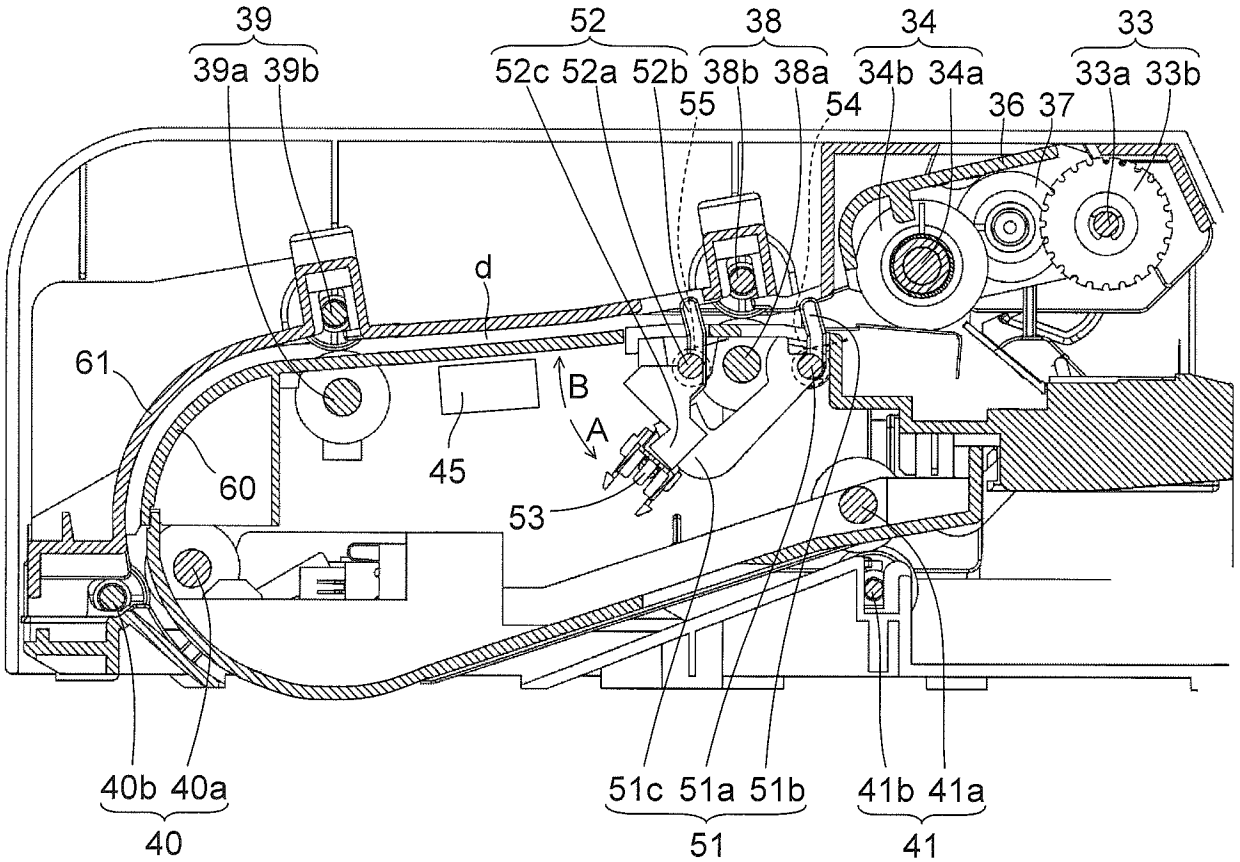
FIG. 4 is a cross-sectional view showing a state in which a first actuator and second actuator of the document conveyance device according to the embodiment of the present disclosure do not pivot in an arrow A direction.

As shown in FIG. 4, the pickup roller 33 has a rotation shaft 33*a*, a roller body 33*b* fixed to the rotation shaft 33*a*. The rotation shaft 33*a* is formed slightly longer than the roller body 33*b*, and disposed on an inner side in a document width direction of a document passage region where the document passes.

The sheet feeding roller 34 has a rotation shaft 34*a*, and a roller body 34*b* fixed to the rotation shaft 34*a*. As shown in FIG. 2, the rotation shaft 34*a* is formed longer than the document passage region in the document width direction, and its one end portion and other end portion are supported rotatably by bearing members 52, 53 that are disposed on outer sides of the inner conveyance guide member 60 and outer conveyance guide member 61 in the document width direction and compose a housing. Besides, the other end portion of the rotation shaft 34*a* is provided with a drive gear (not shown), and a drive force from a drive motor (not shown) is transmitted via a plurality of transmission gears, a clutch and the like.

Besides, a central portion of the rotation shaft 34*a* is provided with a holding member 36 that supports rotatably the pickup roller 33. The holding member 36 is disposed swingably about the rotation shaft 34*a* of the sheet feeding roller 34. In the meantime, a drive force is transmitted from the sheet feeding roller 34 to the pickup roller 33 via an intermediate gear 37 (see FIG. 4) that is disposed in the holding member 36.

As shown in FIG. 3, the conveyance roller pairs 38, 39, 40, and the delivery roller pair 41 include conveyance rollers 38*a*, 39*a*, 40*a*, and 41*a* that are disposed on an inner circumferential side of a conveyance surface of the inner conveyance guide member 60 and pulleys 38*b*, 39*b*, 40*b*, and 41*b* that are disposed on an outer side of a conveyance surface of the outer conveyance guide member 61. The pulleys 38*b*, 39*b*, 40*b*, and 41*b* push the conveyance rollers 38*a*, 39*a*, 40*a*, and 41*a* against the inner circumferential side of the inner conveyance guide member 60, and are driven to rotate by rotations of the conveyance rollers 38*a*, 39*a*, 40*a*, and 41*a*.

Besides, a contact image sensor (reading portion) 45 is disposed between the conveyance roller pair 38 and the conveyance roller pair 39. The contact image sensor 45 reads an image on a rear surface of the document conveyed in the document conveyance path d.

Here, in the present embodiment, as shown in FIG. 4, a first actuator 51, which pivots in a counterclockwise direction (arrow A direction, predetermined direction) by being butted by the document, is disposed at a position of the document conveyance path d between the sheet feeding roller 34 and the conveyance roller pair 38, and a second actuator 52, which pivots in the counterclockwise direction by being butted by the document, is disposed on a more downstream side than the first actuator 51 in the document conveyance direction. The second actuator 52 is disposed at a position of the document conveyance path d between the conveyance roller pair 38 and the contact image sensor 45.

Besides, an optical sensor 53 (hereinafter, called a sensor 53), whose output state is switched based on the pivoting of the first actuator 51 and second actuator 52, is disposed below the second actuator 52.

The sensor 53 is a transmission type sensor, and has a light casting portion 53*a* (see FIG. 6) and a light receiving portion (not shown) that are disposed across a predetermined interval in the document width direction (direction perpendicular to the paper surface of FIG. 4). In a case where the light emitted from the light casting portion 53*a* is received by the light receiving portion, the sensor 53 goes to a transmission state (e.g., on-state), and in a case where the light emitted from the light casting portion 53*a* is not received by the light receiving portion, the sensor 53 goes to a light blocking state (e.g., off-state).

The first actuator 51 is disposed near an end portion (left end portion) of the holding member 36 on the downstream side in the document conveyance direction. Besides, the first actuator 51 has a rotation shaft 51*a*, a butted portion 51*b* that extends upward from the rotation shaft 51*a* and is butted by the document, and a first light blocking portion 51*c* that extends downward from the rotation shaft 51*a* and is able to switch the sensor 53 between a light blocking state and a transmission state.

The butted portion 51*b* is formed to go through the document conveyance path d in a vertical direction, and the inner conveyance guide member 60 and the outer conveyance guide member 61 are provided with slits, which allow a swing of the butted portion 51*b*, at positions corresponding to the butted portion 51*b*.

Besides, the first actuator 51 is biased in a clockwise direction (arrow B direction) by a torsion spring 54 disposed on the rotation shaft 51*a*. Because of this, in a state (state of FIG. 4) in which the butted portion 51*b* is not butted by the document, the first actuator 51 is disposed at a first position (first posture) where the first light blocking portion 51*c* is disposed between the light casting portion 53*a* and light receiving portion of the sensor 53. Besides, in a state (state of FIG. 5) in which the butted portion 51*b* is butted by the document to pivot in the counterclockwise direction (arrow A direction), the first actuator 51 is disposed at a second position (second posture) where the first light blocking portion 51*c* is not disposed between the light casting portion 53*a* and light receiving portion of the sensor 53. In the meantime, the pivoting of the first actuator 51 in the clockwise direction is restricted by an end edge of the slit.

The second actuator 52 has a rotation shaft 52*a*, a butted portion 52*b* that extends upward from the rotation shaft 52*a* and is butted by the document, and a second light blocking portion 52*c* that extends downward from the rotation shaft 52*a* and is able to switch the sensor 53 between the light blocking state and the transmission state.

The butted portion 52*b* is formed to go through the document conveyance path d in the vertical direction, and the inner conveyance guide member 60 and the outer conveyance guide member 61 are provided with slits, which allow a swing of the butted portion 52*b*, at positions corresponding to the butted portion 52*b*.

Besides, the second actuator 52 is biased in the clockwise direction (arrow B direction) by a torsion spring 55 disposed on the rotation shaft 52*a*. Because of this, in a state (state of FIG. 4) in which the butted portion 52*b* is not butted by the document, the second actuator 52 is disposed at a third position (third posture) where the second light blocking portion 52*c* is disposed between the light casting portion 53*a* and light receiving portion of the sensor 53. Besides, in a state (state of FIG. 6) in which the butted portion 52*b* is butted by the document to pivot in the counterclockwise direction (arrow A direction), the second actuator 52 is disposed at a fourth position (fourth posture) where the second light blocking portion 52*c* is not disposed between the light casting portion 53*a* and light receiving portion of the sensor 53. In the meantime, the pivoting of the second actuator 52 in the clockwise direction is restricted by an end edge of the slit.

In the document conveyance device 27, in the state (initial state) in which the document does not pass the first actuator 51 and the second actuator 52, as shown in FIG. 4, the first actuator 51 is disposed at the first position and the second actuator 52 is disposed at the third position. Because of this, the sensor 53 goes to the light blocking state (first state) to output a first output that indicates the light blocking state.

Figure 5:
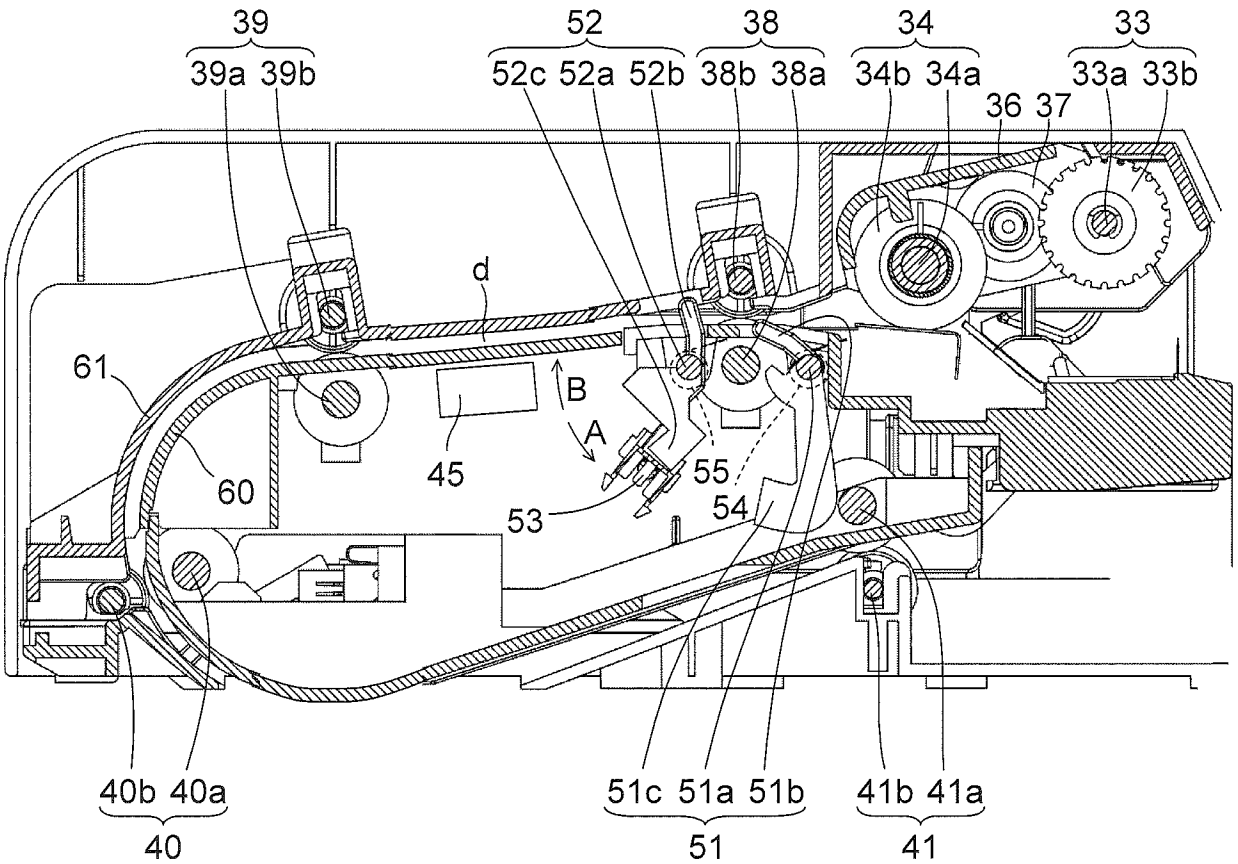
FIG. 5 is a cross-sectional view showing a state in which the first actuator of the document conveyance device according to the embodiment of the present disclosure pivots in the arrow A direction.

And, a sheet feeding operation by the pickup roller 33 and sheet feeding roller 34 is started, and when the tip end of the document passes the first actuator 51, as shown in FIG. 5, only the first actuator 51 of the first actuator 51 and second actuator 52 pivots in the counterclockwise direction (arrow A direction, predetermined direction). In this way, the first actuator 51 is disposed at the second position. At this time, the second actuator 52 is disposed at the third position. Accordingly, the sensor 53 keeps the light blocking state to output the first output that indicates the light blocking state.

Figure 6:
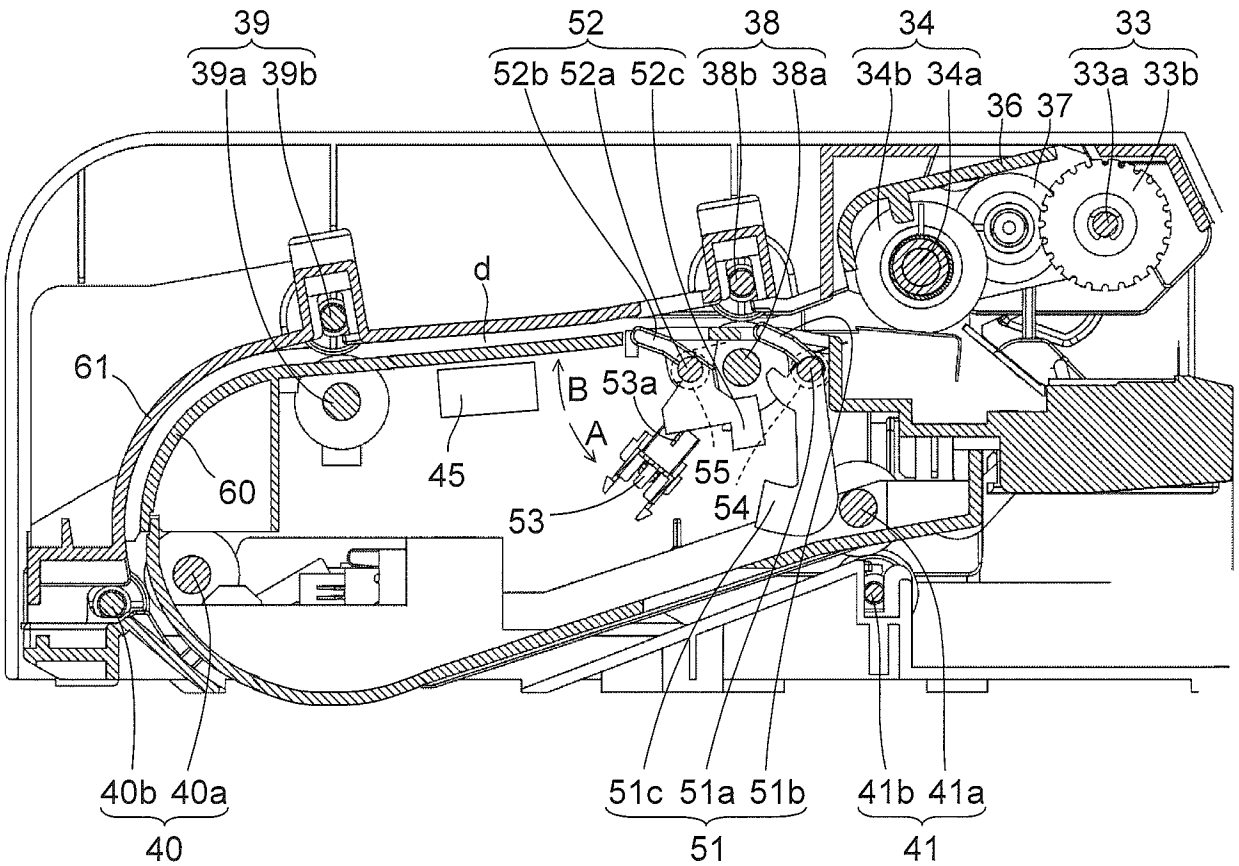
FIG. 6 is a cross-sectional view showing a state in which the first actuator and second actuator of the document conveyance device according to the embodiment of the present disclosure pivot in the arrow A direction.

Thereafter, when the tip end of the document passes the second actuator 52, as shown in FIG. 6, the second actuator 52 pivots in the counterclockwise direction (arrow A direction), whereby both the first actuator 51 and the second actuator 52 go to a state to pivot in the counterclockwise direction (arrow A direction). In this way, the first actuator 51 is disposed at the second position, and the second actuator 52 is disposed at the fourth position. Because of this, the sensor 53 switches to the transmission state (second state) to output a second output that indicates the transmission state. As described above, the output from the sensor 53 switches from the first output to the second output, whereby a control portion (not shown) is able to detect the tip end of the document and count an image reading timing for the contact image sensor 45.

Figure 7:
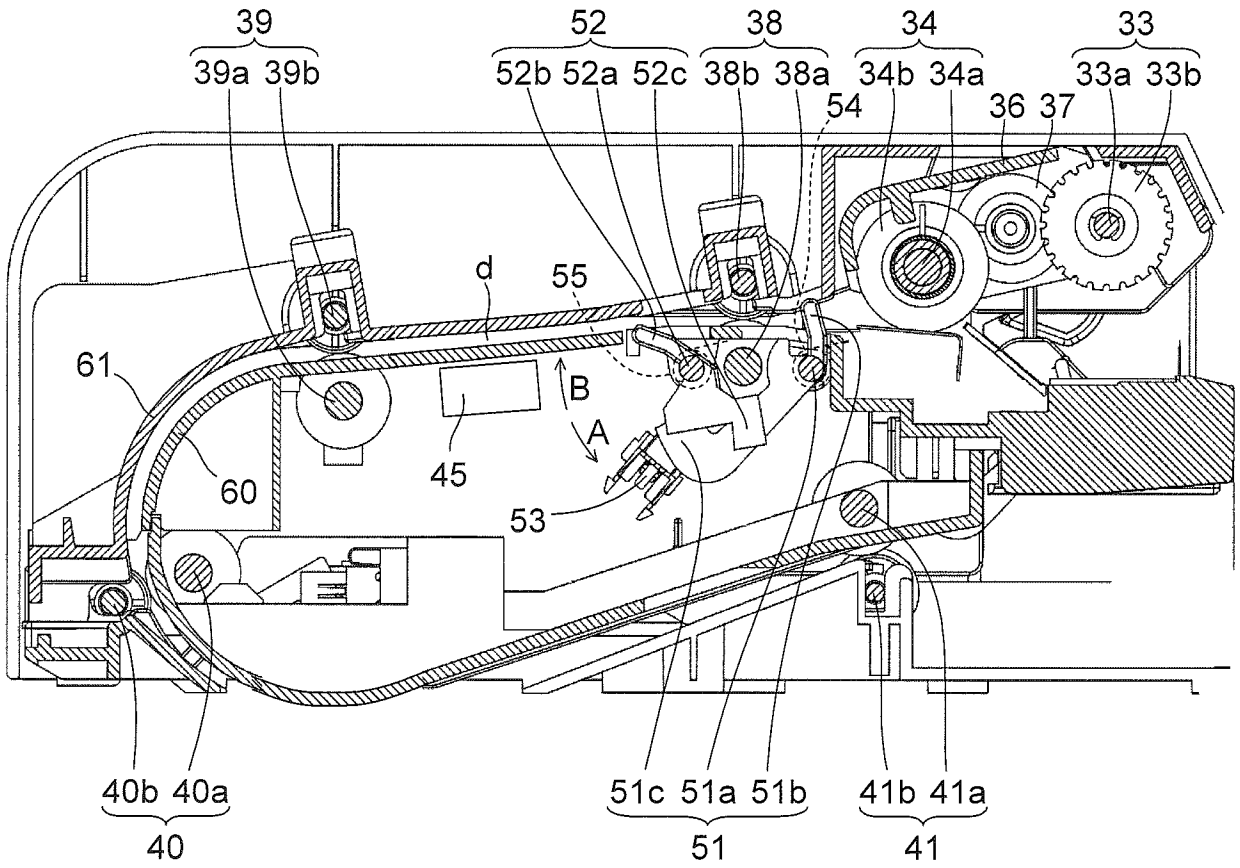
FIG. 7 is a cross-sectional view showing a state in which the first actuator of the embodiment of the present disclosure pivots in an arrow B direction.

And, when the rear end of the document passes the first actuator 51, as shown in FIG. 7, only the first actuator 51 of the first actuator 51 and second actuator 52 pivots in the clockwise direction (arrow B direction). In this way, the first actuator 51 is disposed at the first position. Because of this, the sensor 53 switches to the light blocking state to output the first output that indicates the light blocking state. As described above, the output from the sensor 53 switches from the second output to the first output, whereby the control portion (not shown) is able to detect the rear end of the document and count a timing for the next sheet feeding.

Thereafter, when the rear end of the document passes the second actuator 52, as shown in FIG. 4, the second actuator 52 pivots in the clockwise direction (arrow B direction), whereby both the first actuator 51 and the second actuator 52 go to a state (return to the initial state) to pivot in the clockwise direction (arrow B direction). In this way, the first actuator 51 is disposed at the first position, and the second actuator 52 is disposed at the second position. Because of this, the sensor 53 keeps the light blocking state to output the first output that indicates the light blocking state.

In the present embodiment, as described above, the tip end of the document passes the second actuator 52, whereby the output from the sensor 53 changes from the first output to the second output, while the rear end of the document passes the first actuator 51, whereby the output from the sensor 53 changes from the second output to the first output. Because of this, it is possible to detect the tip end and rear end of the document by means of the one sensor 53 and the two actuators (51, 52). Accordingly, compared with the case where two sensors are disposed, it is possible to alleviate the cost becoming high.

Besides, by disposing the first actuator 51, which detects the rear end of the document, on a more upstream side than the second actuator 52 for detecting the tip end of the document in the document conveyance direction, it is possible to move the first actuator 51 close to the sheet feeding roller 34, and it is possible to shorten a period from a time the document in the document feeding tray 29 is fed to a time the rear end of the document is detected. In this way, it is possible to advance the timing for the next sheet feeding (shorten the time interval between the sheet feedings).

Besides, as described above, the first actuator 51 is disposed between the sheet feeding roller 34 and the conveyance roller pair 38, whereby it is possible to easily move the first actuator 51 close to the sheet feeding roller 34, and it is possible to easily shorten the period from the time the document is fed to the time the rear end of the document is detected. Besides, the second actuator 52 is disposed between the conveyance roller pair 38 and the contact image sensor 45, whereby the tip end of the document is detected with the document nipped by the conveyance roller pair 38. In this way, it is possible to increase accuracy of the image reading timing for the contact image sensor 45.

Besides, as described above, a transmission type sensor is used as the sensor 53, whereby it is possible to more curb the cost compared with a case where a reflection type sensor is used, for example.

Besides, as described above, the first actuator 51 has the first light blocking portion 51*c* and the second actuator 52 has the second light blocking portion 52*c*. Because of this, it is possible to easily switch the sensor 53 between the light blocking state and the transmission state.

Besides, as described above, the first actuator 51 is disposed near the end portion of the holding member 36 on the downstream side in the document conveyance direction. Because of this, it is possible to move the first actuator 51 as close to the sheet feeding roller 34 as possible. Accordingly, it is possible to make the period from the time the document is fed to the time the rear end of the document is detected as short as possible.

In the meantime, the embodiment disclosed this time is an example in all respects and is not limiting. The scope of the present disclosure is not indicated by the above description of the embodiment but by the claims, and all modifications within the scope of the claim and the meaning equivalent to the claim are covered.

For example, in the above embodiment, the example is described, in which a transmission type sensor is used as the optical sensor, but the present disclosure is not limited to this, and it is also possible to use a reflection type sensor as the optical sensor. In this case, the reflection type sensor may be structured in such a way that the light receiving portion detects the light that is emitted from the light casting portion and reflected by the actuator. Besides, the reflection type sensor may be structured in which a reflection member is disposed to oppose the light casting portion and the light receiving portion detects the light that is emitted from the light casting portion and reflected by the reflection member.

What is claimed is:

1. A document conveyance device comprising:

a document conveyance path through which a document passes, a first actuator that is disposed in the document conveyance path and pivots in a predetermined direction by being butted by the document, a second actuator that is disposed on a more downstream side than the first actuator in the document conveyance path in a document conveyance direction and pivots in the predetermined direction by being butted by the document, an optical sensor whose output state is switched based on the pivoting of the first actuator and second actuator, a pickup roller that rotates by being pressed against an uppermost surface of a plurality of the documents loaded and sends the documents, a sheet feeding roller that separates and conveys the documents sent from the pickup roller, a conveyance roller pair that is disposed on a downstream side from the sheet feeding roller in the document conveyance direction and conveys the documents, and a reading portion that is disposed on a downstream side from the conveyance roller pair in the document conveyance direction and reads images on the documents, wherein the optical sensor outputs:

a first output indicating a first state in which the document does not pass the first actuator and the second actuator, the first output in a state in which a tip end of the document passes the first actuator, whereby only the first actuator of the first actuator and second actuator pivots in the predetermined direction, a second output indicating a second state, different from the first state, in which the tip end of the document passes the second actuator, whereby both the first actuator and the second actuator pivot in the predetermined direction, the first output in a state in which a rear end of the document passes the first actuator, whereby the first actuator pivots in a direction opposite to the predetermined direction and the second actuator pivots in the predetermined direction, the first actuator is disposed between the sheet feeding roller and the conveyance roller pair, and the second actuator is disposed between the conveyance roller pair and the reading portion.

2. The document conveyance device according to claim 1, wherein the optical sensor is a transmission type sensor, the first state is a light blocking state, and the second state is a transmission state.

3. The document conveyance device according to claim 2, wherein the first actuator has a first light blocking portion capable of switching the optical sensor between the light blocking state and the transmission state, and the second actuator has a second light blocking portion capable of switching the optical sensor between the light blocking state and the transmission state.

4. The document conveyance device according to claim 1, further comprising:

a holding member that is mounted swingably on a rotation shaft of the sheet feeding roller and holds the pickup roller, wherein the first actuator is disposed near an end portion of the holding member on a downstream side in the document conveyance direction.

5. An image forming apparatus comprising a document conveyance device according to claim 1.

6. A document conveyance device comprising:

a document conveyance path through which a document passes, a first actuator that is disposed in the document conveyance path and pivots in a predetermined direction by being butted by the document, a second actuator that is disposed on a more downstream side than the first actuator in the document conveyance path in a document conveyance direction and pivots in the predetermined direction by being butted by the document, and an optical sensor whose output state is switched based on the pivoting of the first actuator and second actuator, wherein the optical sensor outputs:

a first output indicating a first state in which the document does not pass the first actuator and the second actuator, the first output in a state in which a tip end of the document passes the first actuator, whereby only the first actuator of the first actuator and second actuator pivots in the predetermined direction, a second output indicating a second state, different from the first state, in which the tip end of the document passes the second actuator, whereby both the first actuator and the second actuator pivot in the predetermined direction, and the first output in a state in which a rear end of the document passes the first actuator, whereby the first actuator pivots in a direction opposite to the predetermined direction and the second actuator pivots in the predetermined direction, the optical sensor is a transmission type sensor, the first state is a light blocking state, the second state is a transmission state, the first actuator has a first light blocking portion capable of switching the optical sensor between the light blocking state and the transmission state, and the second actuator has a second light blocking portion capable of switching the optical sensor between the light blocking state and the transmission state.

7. The document conveyance device according to claim 6, further comprising:

a pickup roller that rotates by being pressed against an uppermost surface of a plurality of the documents loaded and sends the documents, a sheet feeding roller that separates and conveys the documents sent from the pickup roller, and a holding member that is mounted swingably on a rotation shaft of the sheet feeding roller and holds the pickup roller, wherein the first actuator is disposed near an end portion of the holding member on a downstream side in the document conveyance direction.

8. An image forming apparatus comprising a document conveyance device according to claim 6.

* * * * *